US007887004B2

(12) United States Patent
Baugher

(10) Patent No.: US 7,887,004 B2
(45) Date of Patent: Feb. 15, 2011

(54) MODULAR AUTOMATIC NON-TURRET WINDER

(76) Inventor: Robert C. Baugher, 2270 Canterbury Cir., Akron, OH (US) 44319

( * ) Notice: Subject to any disclaimer, the term of this patent is extended or adjusted under 35 U.S.C. 154(b) by 0 days.

(21) Appl. No.: 12/156,405

(22) Filed: May 30, 2008

(65) Prior Publication Data

US 2009/0294568 A1 Dec. 3, 2009

(51) Int. Cl.
*B65H 19/22* (2006.01)

(52) U.S. Cl. ..... 242/533.2; 242/599.1

(58) Field of Classification Search ..... 242/533.2, 242/542.3, 559.1, 559.3
See application file for complete search history.

(56) References Cited

U.S. PATENT DOCUMENTS 3,188,016 A * 6/1965 Aaron ..... 242/530.3
3,718,298 A * 2/1973 Lucas ..... 242/413.2
3,746,271 A * 7/1973 Frankel ..... 242/527
3,998,399 A * 12/1976 Held et al. ..... 242/530.4
4,601,435 A * 7/1986 Tomma et al. ..... 242/541.7
4,651,942 A * 3/1987 Tomma ..... 242/533.2
5,317,885 A * 6/1994 Vignoni ..... 66/151

* cited by examiner

*Primary Examiner*—Sang Kim
(74) *Attorney, Agent, or Firm*—Renner, Kenner, Greive, Bobak, Taylor & Weber

(57) ABSTRACT

An automatic winder for a winding part includes a first spindle that rotates clockwise and a second spindle that rotates counterclockwise. A first grip is associated with the first spindle, and a second grip is associated with the second spindle. A guide mechanism is positioned between the first and second spindles, and receives the winding part from a part source and selectively feeds the winding part between the first spindle and the second spindle by selectively feeding the winding part to the first grip and the second grip, wherein said first and second grips are adapted to retain a grip on a lead end of the winding part that is defined by the cutting of the winding part.

13 Claims, 5 Drawing Sheets

MODULAR AUTOMATIC NON-TURRET WINDER

FIELD OF THE INVENTION

The present invention generally relates to a part winder. More particularly, the present invention relates to an automatic non-turret part winder, wherein a guide mechanism selectively feeds the part between neighboring spindle reels, as each reel is filled. In other embodiments, the automatic non-turret part winder is modular, such that multiple part winders can be employed in a relatively small footprint of factory floor space.

BACKGROUND OF THE INVENTION

It is very common for extruded materials to be taken up on spindle reels for shipment. The extruded materials may include polymer materials such as rubbers or plastics and the like or other materials such as rope, cable, or leather and the like. Indeed, virtually any part capable of uptake on a reel and capable of being cut could be employed. A common winding assembly is a turret winding assembly such as that generally shown in FIG. 1. The turret winding assembly is generally designated by the numeral 10 and includes a main housing structure 11, which carries a first spindle 12 and a second spindle 14 on a rotating turret 16. The first and second spindles 12, 14 carry respective first and second reels 18, 20, which serve to gather a part P. In FIG. 1, the part P has been wound onto reel 18, and the turret 16 has been rotated to advance reel 20 into position for cutting part P in order to permit it to be loaded onto reel 20, while reel 18 is in position for removal. More particularly, a part P is secured to a reel in the position of reel 20, and that reel is rotated to accumulate the part P. Once that reel is full, the turret 16 is rotated in the direction of arrow A to place the full reel on the left, while placing an empty reel on the right, in position to receive a cut end of the part P and continue the part accumulating process. The full reel is removed at the left position and replaced with an empty reel on the spindle 12.

In the position shown in FIG. 1, reel 18 is full, and has been rotated from the position shown occupied by reel 20 to its current position. The part P is still one continuous part wound on reel 18 and extending back through a part guide 22 and back to the part source (not shown). The part P extends through a gripper 24 associated with the spindle 14, and the part P is gripped thereby. Thereafter, a cutter 26 is operated to cut the part P, for example by a blade 30 advanced towards the part P. Thus, the new free end of part P is gripped by the gripper 24 associated with reel 20, while the length of part P wound on reel 18 is disconnected from the part source and therefore can be removed and replaced with an empty reel. With the part gripped by gripper 24, the reel 20 can be rotated in the direction of spindle 14, thus taking additional length of part P onto reel 20. Once spindle 20 is full, turret 16 can again be rotated in the direction of arrow A, bringing the now empty reel 18 into position below the cutter. At this position, the associated gripper 28 would grab the part P to then associate the new free end of the part P with the reel 18. It should be appreciated that the cutting of the part P gathered on the reels may be timed by a controller C, suitably programmed to grip, cut, rotate spindles and rotate the turret, as necessary for the take-up of the part P.

While such turret winders are somewhat effective, and are beneficially employed in the art, the turret itself is an unnecessary and overly complex element of the design. The turret winder takes up a significant amount of floor space in relation to the two reels that it carries for accumulating the winding part. Thus, the present invention provides a simpler non-turret winder design, which can provide multiple reels in a given floor space footprint.

SUMMARY OF THE INVENTION

This invention provides an automatic winder for a winding part. The winder includes a first spindle that rotates clockwise and a second spindle that rotates counterclockwise. A first grip is associated with the first spindle, and a second grip is associated with the second spindle. A guide mechanism is positioned between the first and second spindles, and receives the winding part from a part source and selectively feeds the winding part between the first spindle and the second spindle by selectively feeding the winding part to the first grip and the second grip, wherein said first and second grips are adapted to retain a grip on a lead end of the winding part that is defined by the cutting of the winding part.

DETAILED DESCRIPTION OF ILLUSTRATIVE EMBODIMENTS

Figure 1:
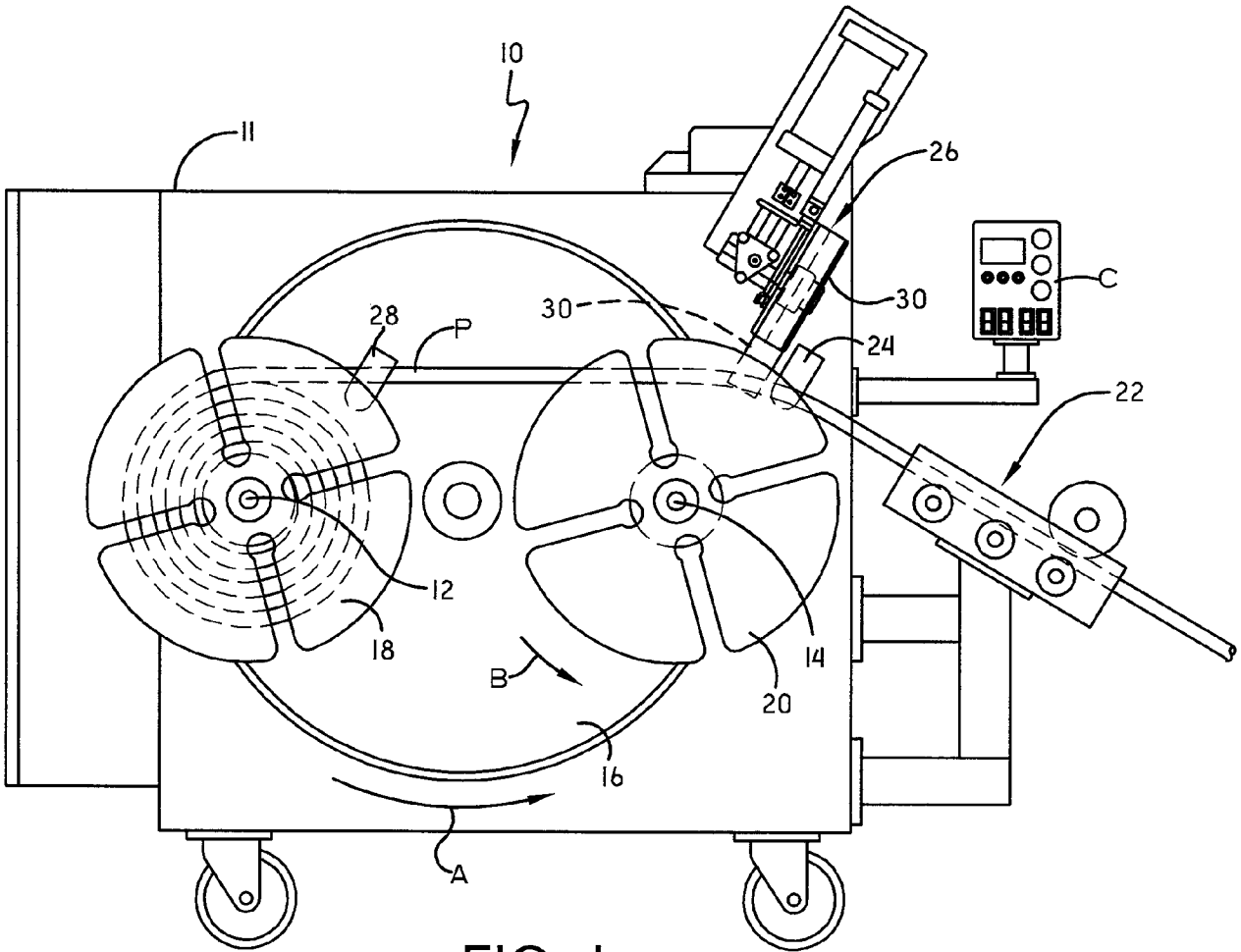
FIG.-1 PRIOR ART
FIG. 1 is a front elevational view of a turret winding assembly of the prior art.

An automatic non-turret winder in accordance with the present invention is shown in FIGS. 2-6 and designated by the numeral 110. The winder 110 includes a first spindle 112, which rotates in a clockwise direction (arrow C) upon actuation of a first motor 113, and a second spindle 114, which rotates in a counterclockwise direction (arrow D) upon actuation of a second motor 115. The first spindle 112 receives a first reel 116, and the second spindle 114 receives a second reel 118. These reels 116, 118 slide on and off of their respective spindles 112, 114, being removed from the spindle when they are full, to be replaced with a new, empty reel, as generally known in the art of turret winders. These reels 116, 118 are placed on the spindles to receive a winding part P. The winding part P is to be understood as a continuous length of material capable of being wound upon a reel and cut, and is not to be limited to any particular material. However, the present invention is most concerned with the winding of polymeric materials such as rubbers or plastics. The winding part P is fed to the automatic non-turret winder 110 from a part source S, which can be any suitable winding parts stock source, though the present invention is most concerned with the continuous feeding of polymeric materials from an extruder, unwind stand, or let-off reel or any large stock source.

A first grip cutter 120 (more easily observed in FIGS. 3-6) is associated with a first backplate 121 associated with the first spindle 112 to rotate therewith, and a second grip cutter 122 is associated with a second backplate 123 associated with the second spindle 114 to rotate therewith. These first and second grip cutters 120, 122 are adapted to grip and cut the winding part P fed thereto. More particularly, these grip cutters 120, 122 will grip a length of the winding part P, and will cut it to create a new lead end coming from the part source S, and will also retain a grip on the lead end created by that cut. It should be appreciated that it would also be acceptable to employ grips associated with the spindles, and have separate cutting elements. Thus, elements that both grip and cut are not absolutely necessary for practicing this invention, though such grip cutters are preferred because they tend to simplify the design.

A guide mechanism 124 is position between the first and second spindles 112, 114, and receives the winding part P from the part source S, and selectively feeds it between the two spindles 112, 114. More particularly, the guide mechanism 124 includes a first guide pulley 126 and a second guide pulley 128, and the winding part P is fed between the first and second guide pulleys 126, 128, after first passing over a length counter pulley 130. A drive mechanism M provides the main drive elements and process controls necessary to selectively rotate the first and second spindles 112, 114 and adjust the guide mechanism 124 to selectively associate the winding part P with the appropriate spindle and associated reel, as will be appreciated from the general process description that follows.

Figure 2:
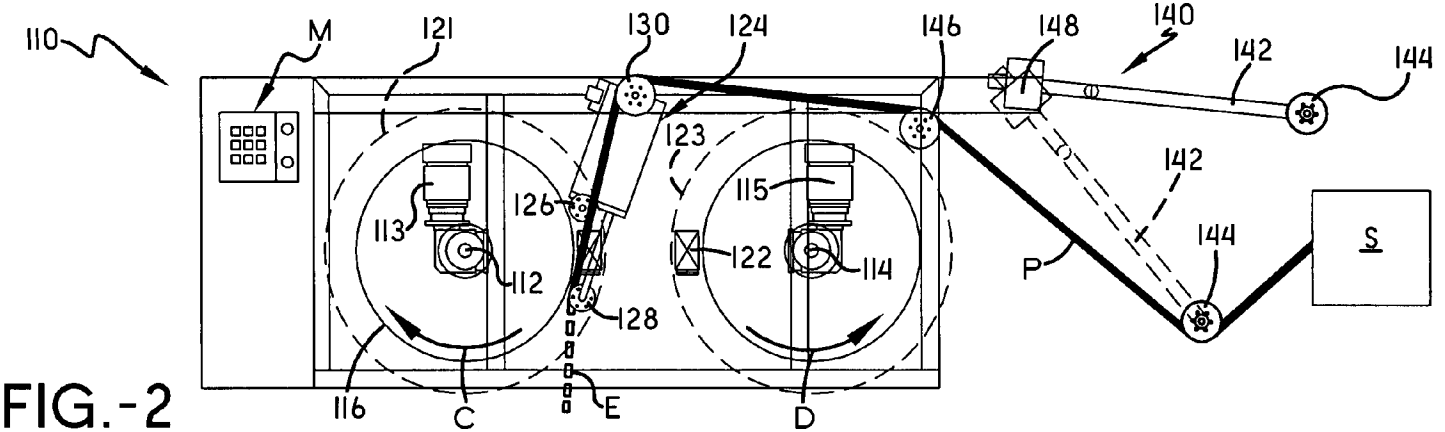
FIG. 2 is a general schematic of a non-turret winder assembly in accordance with this invention, showing the initial feeding of a part P to a first spindle.
Figure 3:
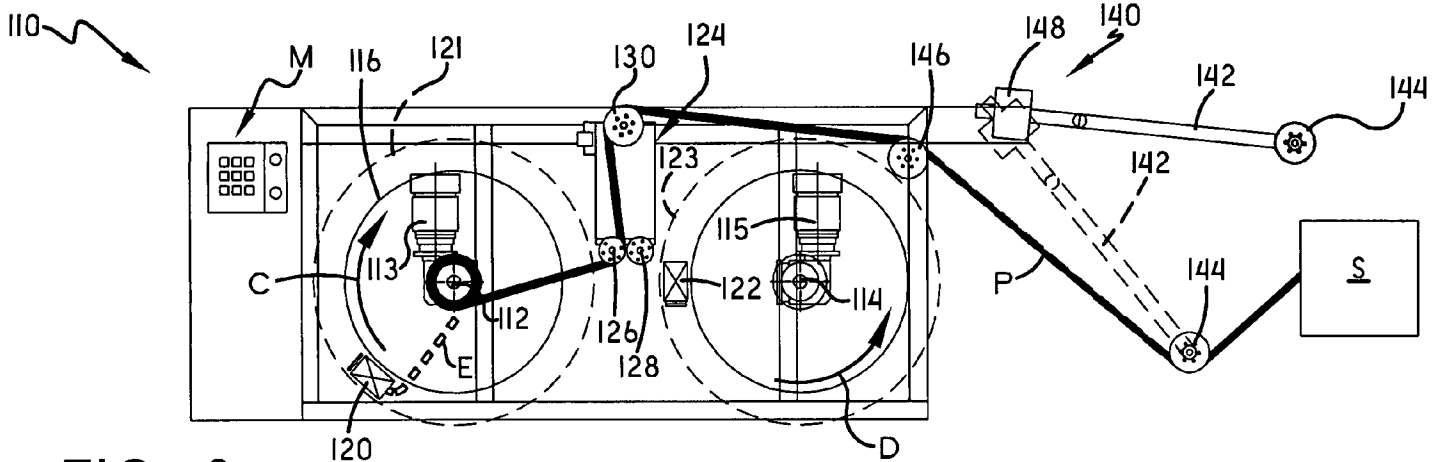
FIG. 3 is a general schematic as in FIG. 1, showing the winding of the part P on the first spindle.

FIG. 2 may be considered to show the hand start for the take-up process of accumulating the winding part P. A worker will hand feed the lead edge E of the winding part P over the length counter pulley 130 and between the first and second guide pulleys 126, 128. Although it is not critical to first associate the winding part P with a particular spindle, the figures provide that the worker first associates the winding part P with the first spindle 112 and removable reel 116. Thus, the guide mechanism 124 is angled toward the first spindle 112, as shown, and the worker places the lead end of the part in the grip cutter 120, which grips the part P. The worker then initiates the winding process by appropriately manipulating the drive mechanism M (for example, by pressing a "start" button). This causes the first spindle 112 to rotate in the clockwise direction. Because the grip cutter 120 is associated with the spindle 112 to rotate therewith, the lead end of the part P is pulled around the central axis of the spindle 112 and is wound about the reel 116. As seen in FIG. 3, the first guide pulley 126 holds the part P in position so that the grip cutter 120 winds the part P on the reel 116 as it rotates about the central axis.

Figure 4:
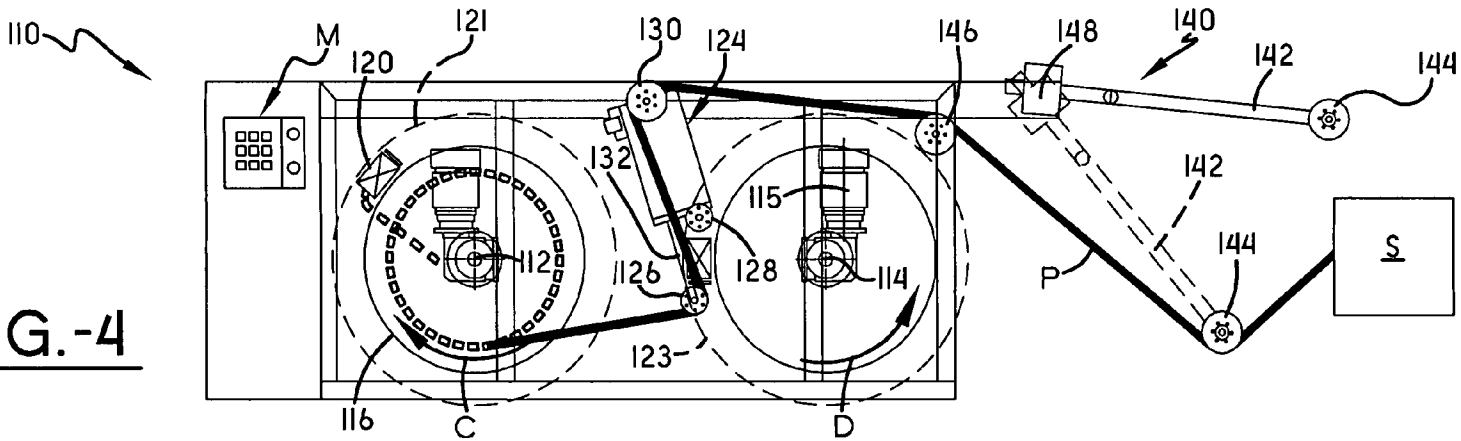
FIG. 4 is a general schematic as in FIG. 3, showing the transferring of the part P from the first spindle to the second spindle.
Figure 5:
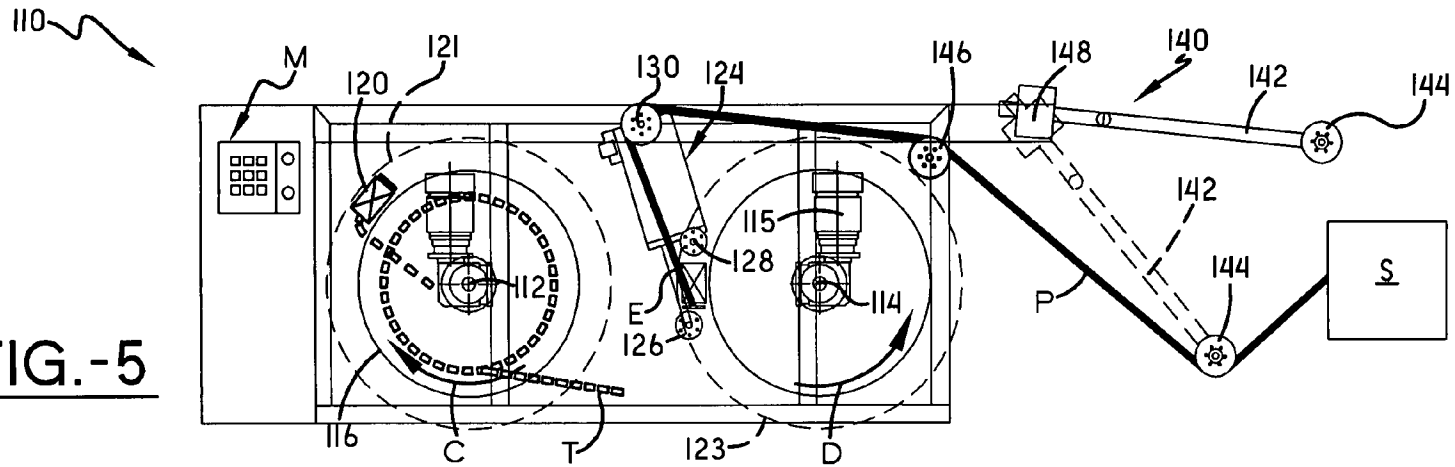
FIG. 5 is a general schematic as in FIG. 4, showing the completion of the transfer of the part P to the second spindle.
Figure 6:
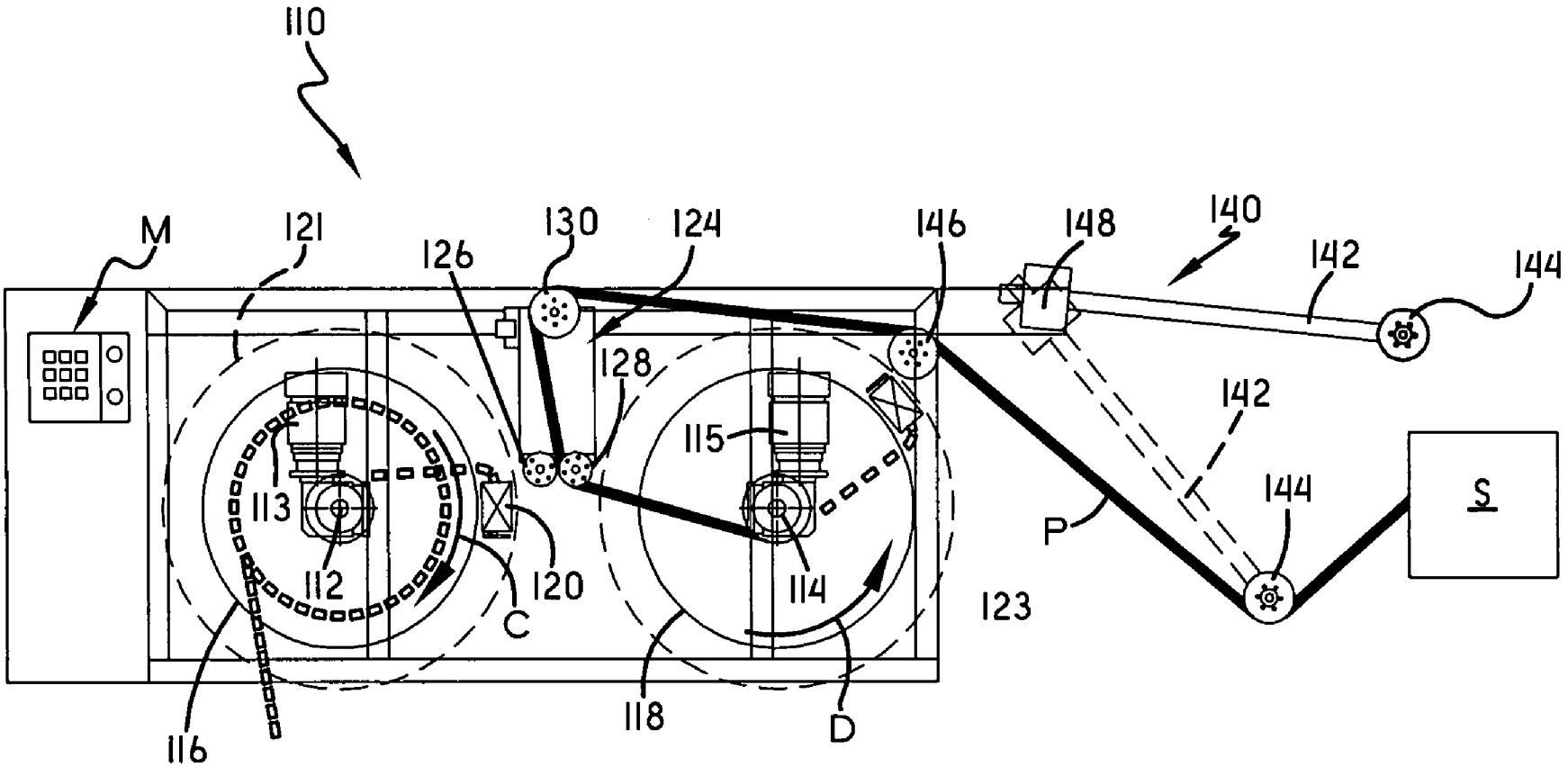
FIG. 6 is a general schematic as in FIG. 5, showing the winding of the part P on the second spindle.

The reel 116 can hold up to a given length of the part P, and this length is measured by the length counter pulley 130. Thus, when the appropriate length of the part P has passed over the length counter pulley 130, a message is sent to the drive mechanism M, to initiate the switching of the part P from the first spindle 112 to the second spindle 114. As seen in FIG. 4, the first guide pulley 126 is extended on a shaft 132, and the guide mechanism 124 pivots toward the second spindle 114 to position a length of the winding part P in the second grip cutter 122. This places the winding part P in position to be gripped and cut by the second grip cutter 122, thus creating a tail end T of the winding part P taken up on the first reel 116, and creating a lead end E of the winding part P now associated with the second grip cutter 122 (see FIG. 5). Once the winding part P is gripped and cut by the second grip cutter 122, the second spindle 114 is rotated in the counter-clockwise direction, while the first guide pulley 126 retracts and the guide mechanism 124 returns to a neutral position, as seen in FIG. 6. Continued rotation of the second spindle 114 causes the winding part P to be taken up on the second reel 118, substantially as with the first reel 116.

Once the winding part P is transferred and cut and the part P begins to be wound about the second spindle 114, the worker can unload the first reel 116, and replace it with a new, empty reel. More particularly, as illustrated in FIG. 6, the first spindle 112 associated with the full reel 116 will jog into position where the grip cutter 120 is suitably placed for receiving the winding part P substantially as shown and described with respect to the second grip cutter 122 and the transfer of the winding part P shown in FIG. 4. The worker can then release the winding part P from the grip cutter 120, remove the filled reel 116 and replace it with an empty reel. This process is repeated as desired to take up a desired length of the winding part P. Notably, the second guide pulley 128 extends on a shaft 134 to place the part P into first grip cutter 120, when transferring to first reel 116.

It will be appreciated that, during a transfer, the winding part P will still be advancing from the part source S toward the automatic winder 110, though, for a small period of time, none of the winding part P will be taken up on a reel. Thus, a dancer mechanism 140 is provided between the part source S and the automatic winder 110. The dancer assembly 140 includes a pivot arm 142 and a distal pulley 144. The part source extends under the distal pulley 144, extends over feed pulley 146 and then extends to the length counter pulley 130, as already described. During the transfer step, the pivot arm 142 pivots downwardly from its support 148 to thereby take up additional length of the winding part P while the transfer is occurring. This can prevent the winding part P from accumulating on the floor of the factory. Once the transfer is complete and the new spindle and reel begin to rotate and take up lengths of the winding part P, the dancer may be moved back to the original position shown in solid lines in the Figures. In a particularly embodiment, the pivot arm 142 of the dancer assembly 140 is biased downwardly, such that the dancer assembly tends to push on the winding part P. However, this biased force is overcome by the force created by the pulling of the winding part between the spindles and the extruder. Thus, while the winding part is being wound on a spindle, the tension created in the winding part tends to advance the pivot arm 142 of the dancer assembly 140 upwardly, and, when the winding part is being transferred between spindles, the pivot arm 142 of the dancer assembly 140 moves downwardly as a result of the biased force, thereby taking up some of the slack in the length of the winding part.

It should be appreciated that the automatic non-turret winder 110 shown in the figures and described above provides significant advantages over the turret winders of the prior art. Particularly, the non-turret winder 110 has a significantly less complex design, having no large rotational turret. In the turret winders of the prior art, it was necessary to rotate the reels into position below the cutter, whereas in this invention the reels remain stationary and the winding part P is manipulated to associate it with a given reel. Because of the rotating turret in the turret winders, slip rings and other complex structures must be employed to provide power to the rotating elements. This increases the cost and complexity of the turret winder design. Such concerns are minimized with the non-turret winder of the present invention.

Figure 7:
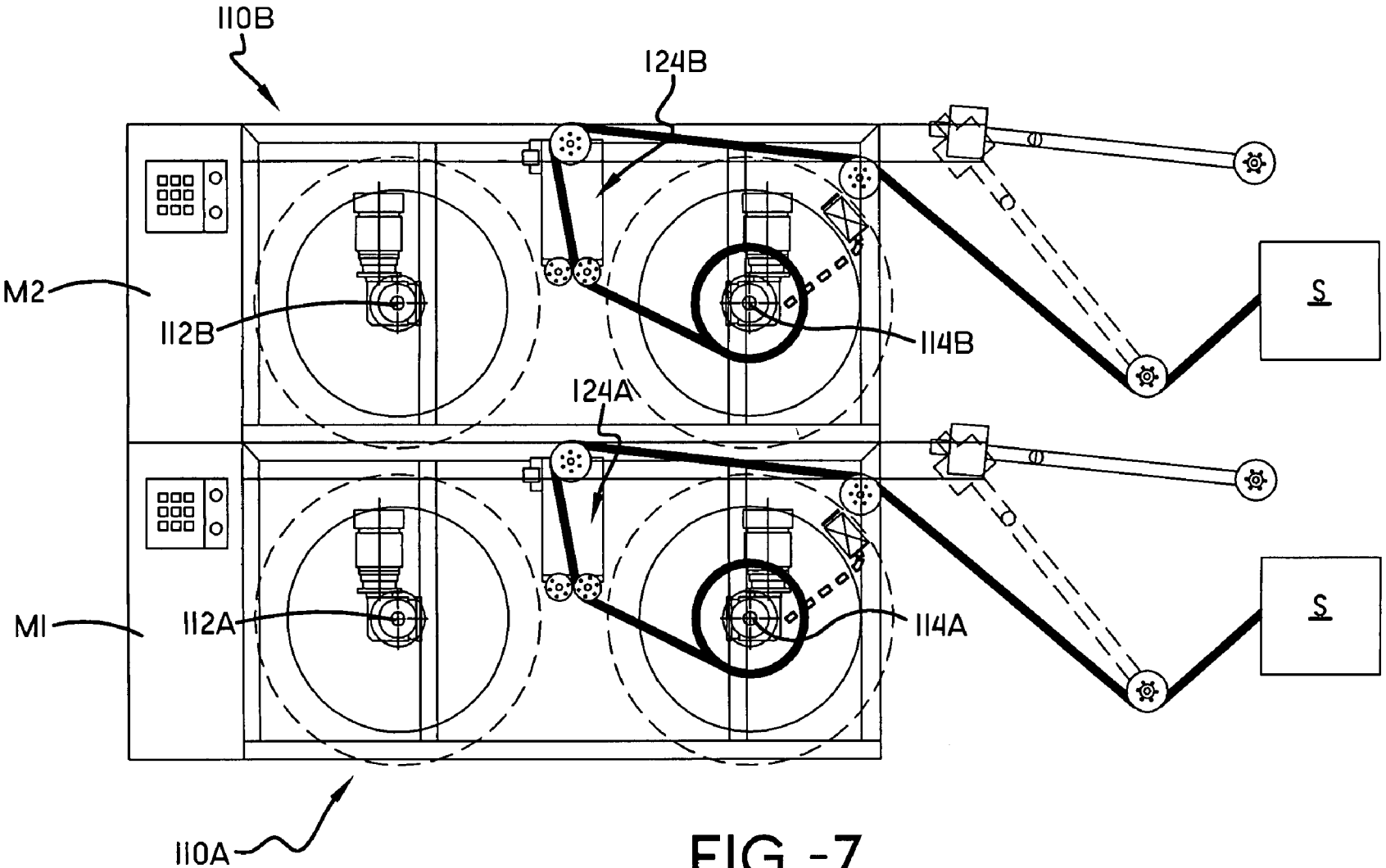
FIG. 7 is a general schematic showing how the non-turret winder of FIGS. 2-6 can be employed as a module of a larger, modular non-turret winder, increasing the number of parts and length of parts that can be taken up onto reels in a given footprint of floor space.

In FIG. 7, it can be seen that the non-turret winder of this invention lends itself to a very beneficial modular assembly. Particularly, FIG. 7 shows two automatic non-turret winders 110A and 110B in a stacked assembly. Each modular winder may include its own drive mechanism, as indicated at M1 and M2, or a single drive mechanism may be associated with the stacked assembly, to provide all the process controls and drive mechanisms necessary to manipulate the various spindles 112A, 112B, 114A, 114B and various guide mechanisms 124A, 124B of the modular assembly. Because the reels are not mounted on a turret, the vertical profile of this stacked assembly is approximately of the same size as a single turret winder, due to the fact that the turret winder must accommodate the rotation of the reels about a common center.

In light of the foregoing, it should be appreciated that the present invention substantially improves the art by providing a non-turret winder of a simple and potentially modular structure. While only particular embodiments of the invention of been disclosed in accordance with the patent statutes, it should be appreciated that the present invention is not limited thereto or thereby. Rather, those of ordinary skill in the art will appreciate the potential for deviating from these particular embodiments, and the scope of this invention shall be determined by the following claims.

What is claimed is:

1. An automatic winder for a winding part comprising:

a first spindle that rotates clockwise about an axis;

a first grip associated with said first spindle to rotate around said first axis;

a second spindle that rotates counterclockwise about an axis;

a second grip associated with said second spindle to rotate around said second axis;

a guide mechanism positioned between said first and second spindles, said guide mechanism receiving the winding part from a part source and selectively feeding the winding part between said first spindle and said second spindle by selectively feeding the winding part to said first grip and said second grip, wherein said first and second grips retain a grip on each selective leading end of the winding part from said part source, said leading end defined by the cutting of the winding part.

2. The automatic winder of claim 1, said first and second grips are also adapted to cut said winding part.

3. The automatic winder of claim 2, wherein clockwise rotation of said first spindle, when said lead end of said winding part is held by said first grip, causes said winding part to be wound about a central axis of said first spindle.

4. The automatic winder of claim 3, wherein counterclockwise rotation of said second spindle, when said lead end of said winding part is held by said second grip causes said winding part to be wound about a central axis of said second spindle.

5. The automatic winder of claim 4, further comprising a first reel removably held on said central axis of said first spindle to receive said winding part, and a second reel removably held on said central axis of said second spindle to receive said winding part.

6. The automatic winder of claim 1, wherein said guide mechanism includes a central pulley, a first guide pulley, and a second guide pulley.

7. The automatic winder of claim 6, wherein said first guide pulley selectively moves from a retracted position to an extended position along a first line of extension, said second guide pulley selectively moves from a retracted position to an extended position along a second line of extension.

8. The automatic winder of claim 7, wherein said central pulley is spaced from said first and second guide pulleys and positioned between said first and second lines of extension.

9. The automatic winder of claim 7, wherein said guide mechanism pivots between a position angled toward said first spindle and a position angled toward said second spindle.

10. An automatic winder for a winding part comprising:

a first spindle that rotates clockwise;

a first grip associated with said first spindle;

a second spindle that rotates counterclockwise;

a second grip associated with said second spindle;

a guide mechanism positioned between said first and second spindles, said guide mechanism receiving the winding part from a part source and selectively feeding the winding part between said first spindle and said second spindle by selectively transferring the winding part to said first grip and said second grip, wherein said first and second grips are adapted to retain a grip on a lead end of the winding part from said part source, said lead end defined by a cutting of the winding part after transfer, wherein clockwise rotation of said first spindle, when said lead end of said winding part is held by said first grip, causes said winding part to be wound about a central axis of said first spindle, wherein counterclockwise rotation of said second spindle, when said lead end of said winding part is held by said second grip causes said winding part to be wound about a central axis of said second spindle, wherein said part source feeds said winding part to said guide mechanism of said automatic winder at a feed rate, and said first and second spindles are programmed to rotate so as to uptake the winding part on their respective central axes at approximately that feed rate to avoid a lag between the feeding from said part source and the uptake of said spindles; and a dancer mechanism positioned between said part source and said guide mechanism to take up a length of the winding part during transfer of said winding part between said first and second spindles.

11. An automatic winder for a winding part comprising:

a first spindle that rotates clockwise;

a first grip associated with said first spindle;

a second spindle that rotates counterclockwise;

a second grip associated with said second spindle;

a guide mechanism including a central pulley, a first guide pulley, and a second guide pulley, wherein said first guide pulley selectively moves from a retracted position to an extended position along a first line of extension, said second guide pulley selectively moves from a retracted position to an extended position along a second line of extension, said guide mechanism being positioned between said first and second spindles and pivoting between a position angled toward said first spindle and a position angled toward said second spindle, said guide mechanism receiving the winding part from a part source and selectively feeding the winding part between said first spindle and said second spindle by selectively feeding the winding part to said first grip and said second grip, wherein said first and second grips are adapted to retain a grip on a lead end of the winding part from said part source, said lead end defined by the cutting of the winding part, and further wherein, when (a) said guide mechanism is pivoted at the position angled toward said first spindle, (b) said second guide pulley is moved to its extended position along said second line of extension, and (c) said winding part extends over said central pulley and between said first and second guide pulleys, said second guide pulley retains a length of said winding part in position to be gripped by said first grip.

12. The automatic winder of claim 11, wherein said first grip is associated with said first spindle to rotate therewith, and said second grip is associated with said second spindle to rotate therewith.

13. The automatic winder of claim 11, wherein, when (a) said guide mechanism is pivoted at the position angled toward said second spindle, (b) said first guide pulley is moved to its extended position along said first line of extension, and (c)said winding part extends over said central pulley and between said first and second guide pulleys, said first guide pulley retains a length of said winding part in position to be gripped by said second grip.

* * * * *